US006460850B1

(12) United States Patent
Dodek, II

(10) Patent No.: US 6,460,850 B1
(45) Date of Patent: Oct. 8, 2002

(54) CUBE PUZZLE

(76) Inventor: Samuel M. Dodek, II, 12808 Huntsman Way, Potomac, MD (US) 20854

( * ) Notice: Subject to any disclaimer, the term of this patent is extended or adjusted under 35 U.S.C. 154(b) by 0 days.

(21) Appl. No.: 09/861,146

(22) Filed: May 21, 2001

Related U.S. Application Data

(60) Provisional application No. 60/249,165, filed on Nov. 17, 2000.

(51) Int. Cl.[7] ..... A63F 9/06

(52) U.S. Cl. ..... 273/156; 273/160; 446/123

(58) Field of Search ..... 273/153 R, 156, 273/160; 446/123, 144; 434/260, 401, 403

(56) References Cited

U.S. PATENT DOCUMENTS 1,172,385 A * 1/1916 Muller ..... 446/123
1,701,190 A * 2/1929 Paulson ..... 446/123
3,813,099 A * 5/1974 Scott ..... 273/156
4,692,119 A * 9/1987 Ussery ..... 273/156
5,152,530 A 10/1992 Dodek, II
5,564,703 A 10/1996 McGuire

* cited by examiner

*Primary Examiner*—Steven Wong
(74) *Attorney, Agent, or Firm*—Donald A. Kettlestrings

(57) ABSTRACT

A puzzle forming a cube when assembled includes a plurality of hexahedron blocks, each block defining at least one hole therein which passes completely through the block. A plurality of fastening elements of substantially identical dimensions with respect to each other are provided, and the blocks are assembled together in a predetermined manner to form a cube with each of the fastening elements passing through predetermined holes of the blocks.

11 Claims, 6 Drawing Sheets

CUBE PUZZLE

This application claims the benefit of provisional application No. 60/249,165, filed Nov. 17, 2000.

BACKGROUND OF THE INVENTION

This invention relates to puzzles and more particularly to a puzzle forming a cube when assembled.

BRIEF SUMMARY OF THE INVENTION

An object of the present invention is to provide a three dimensional cube puzzle.

Another object is to provide such a puzzle which is educational and entertaining.

A further object of the invention is the provision of such a puzzle which can be used to increase and expand individual and group thinking skills and decision-making experiences.

Still another object is to provide such a puzzle which teaches problem solving skills.

A still further object is to provide such a puzzle which can be used in physical rehabilitation to strengthen fingers that have become weakened or stiff.

Additional objects and advantages of the invention will be set forth in part in the description which follows, and in part will be obvious from the description, or may be learned by practice of the invention. The objects and advantages are realized and attained by means of the instrumentalities and combinations particularly pointed out in the appended claims.

To achieve these and other objects, the present invention provides a puzzle forming a cube when assembled, the puzzle comprising: a plurality of hexahedron blocks, each block defining at least one hole therein which passes completely through the block; a plurality of fastening elements of substantially identical dimensions with respect to each other; and wherein the blocks can be assembled together in a predetermined manner to form a cube with each of the plurality of fastening elements passing through predetermined holes of the blocks.

It is to be understood that both the foregoing general description and the following detailed description are exemplary and explanatory but are not restrictive of the invention.

BRIEF DESCRIPTION OF THE SEVERAL VIEWS OF THE DRAWINGS

The accompanying drawings, which are incorporated in and constitute a part of this specification, illustrate a preferred embodiment of the invention and, together with the description, serve to explain the principles of the invention.

DETAILED DESCRIPTION OF THE INVENTION

Figure 1:
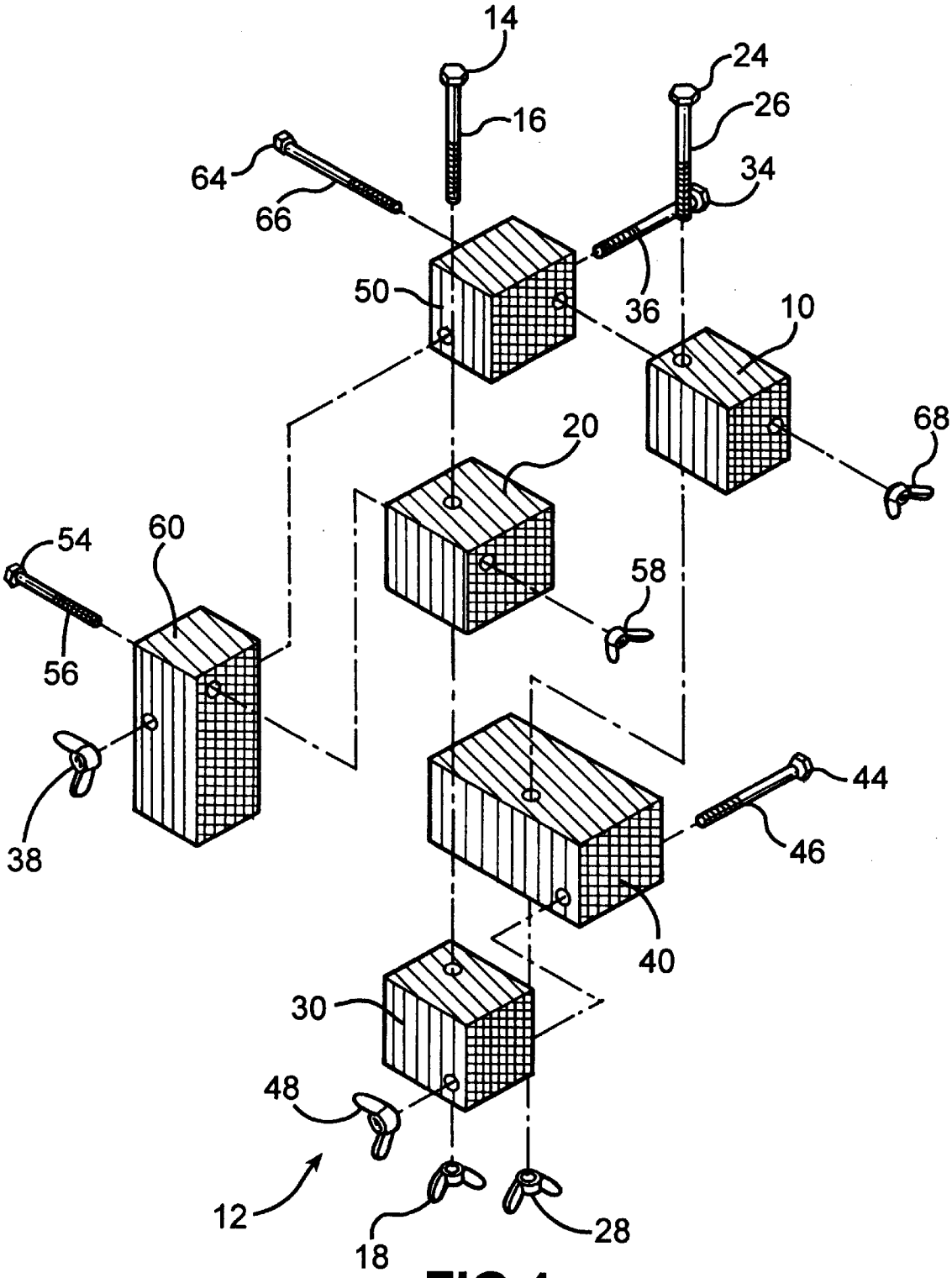
FIG. 1 is an exploded perspective view of the puzzle showing the top, front and left sides of the blocks.
Figure 2:
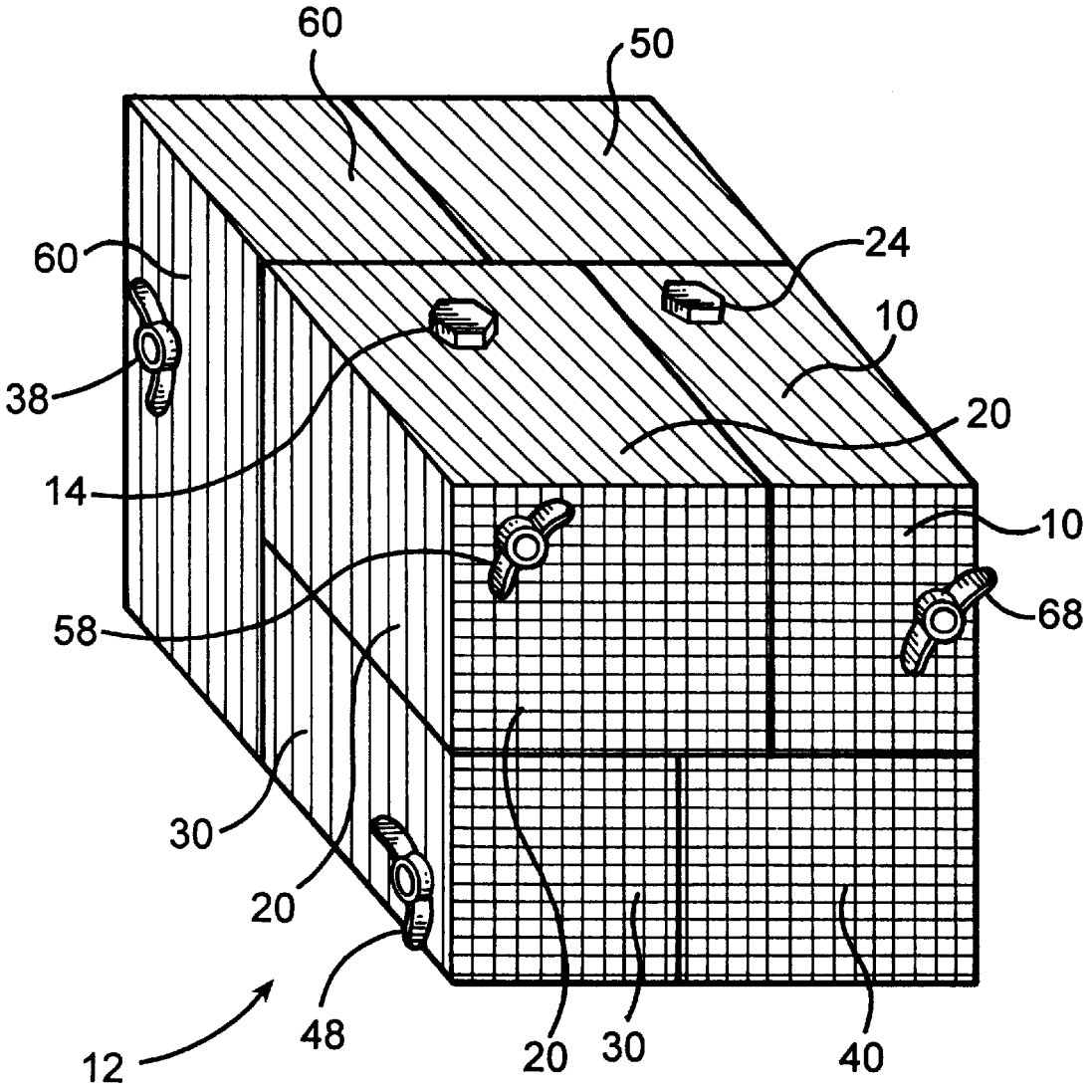
FIG. 2 is a perspective view of the assembled puzzle showing the top, front and left sides of the blocks.
Figure 3:
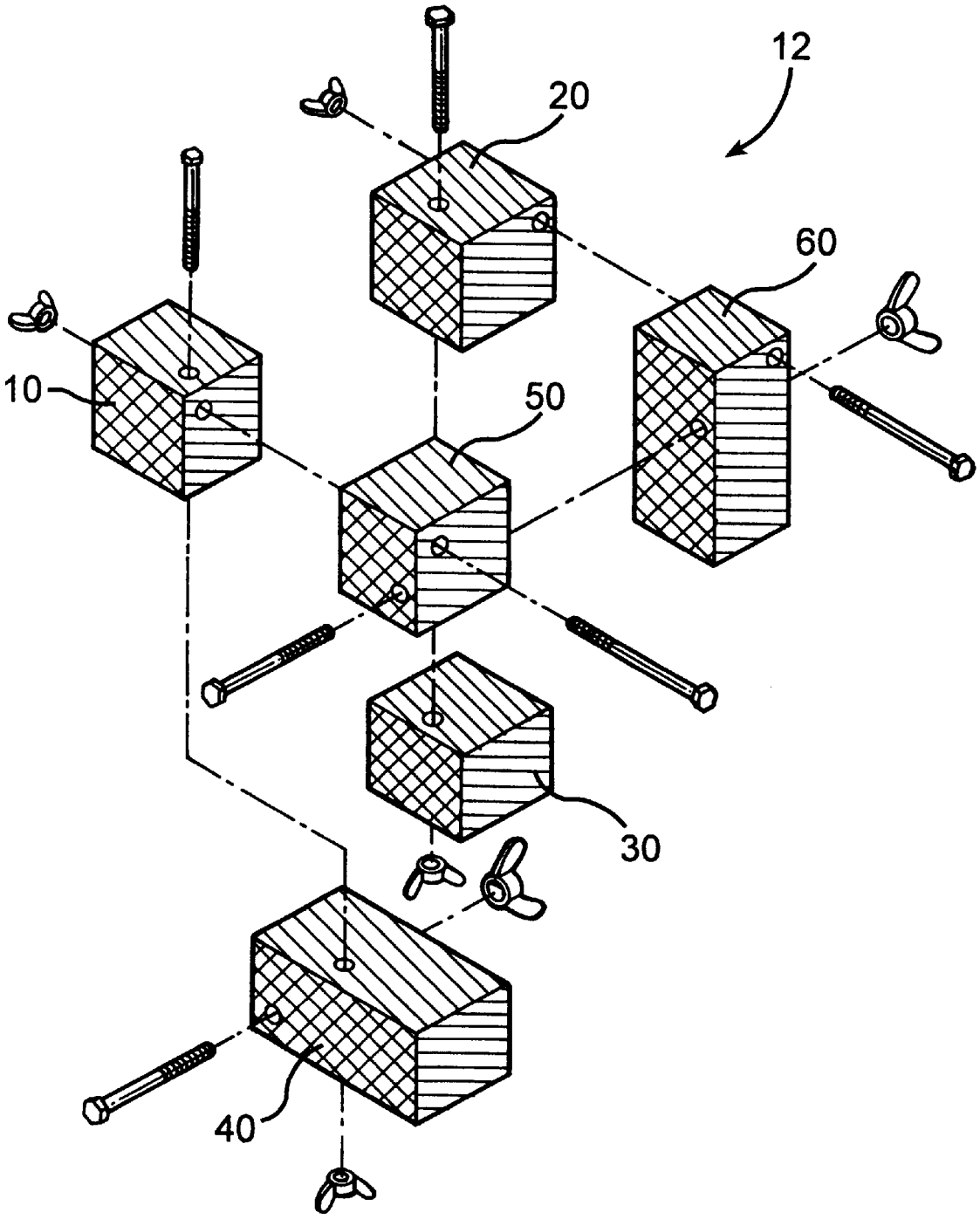
FIG. 3 is an exploded perspective view of the puzzle showing the top, rear and right sides of the blocks.
Figure 4:
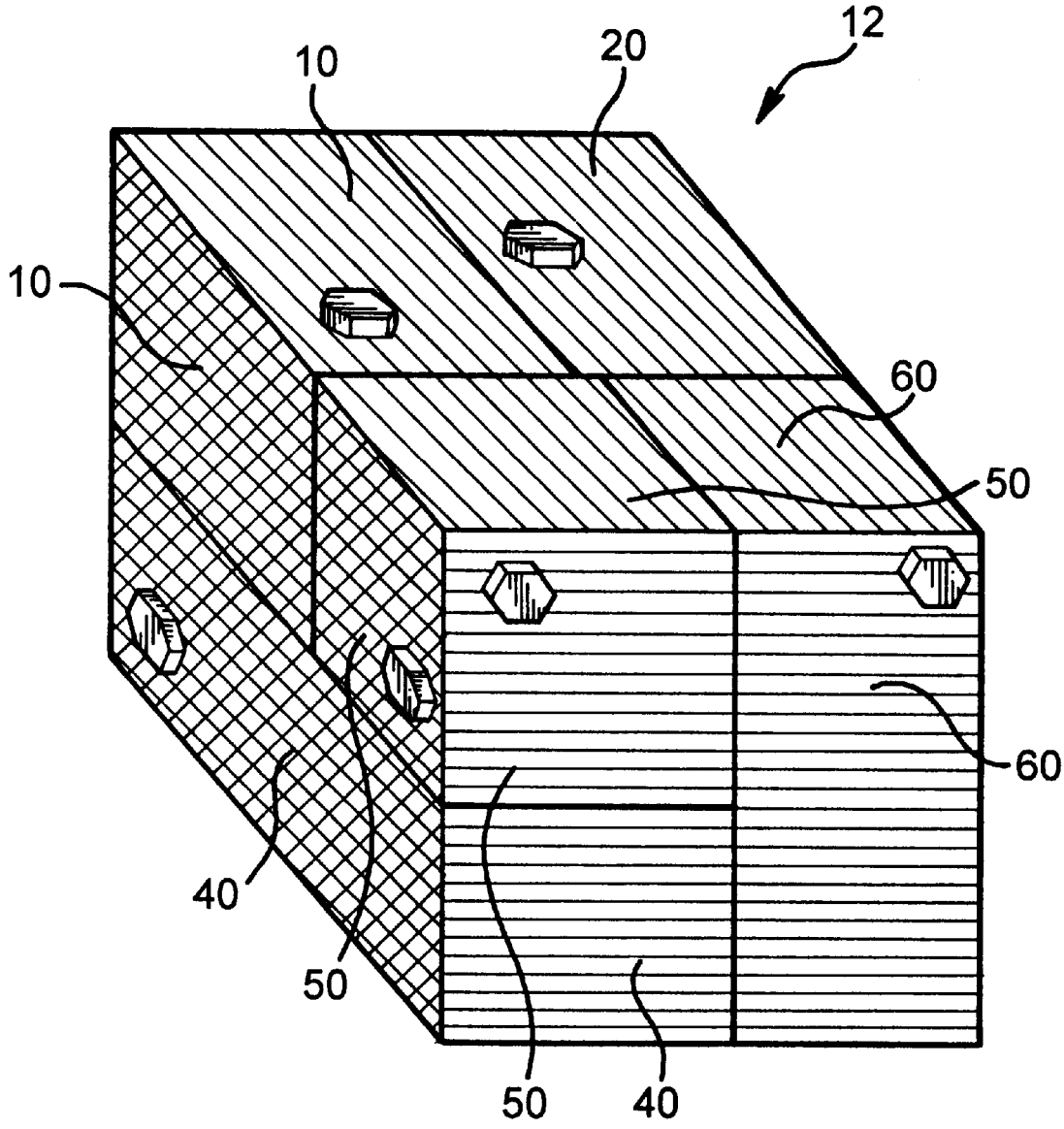
FIG. 4 is a perspective view of the assembled puzzle showing the top, rear and right sides of the blocks.
Figure 5:
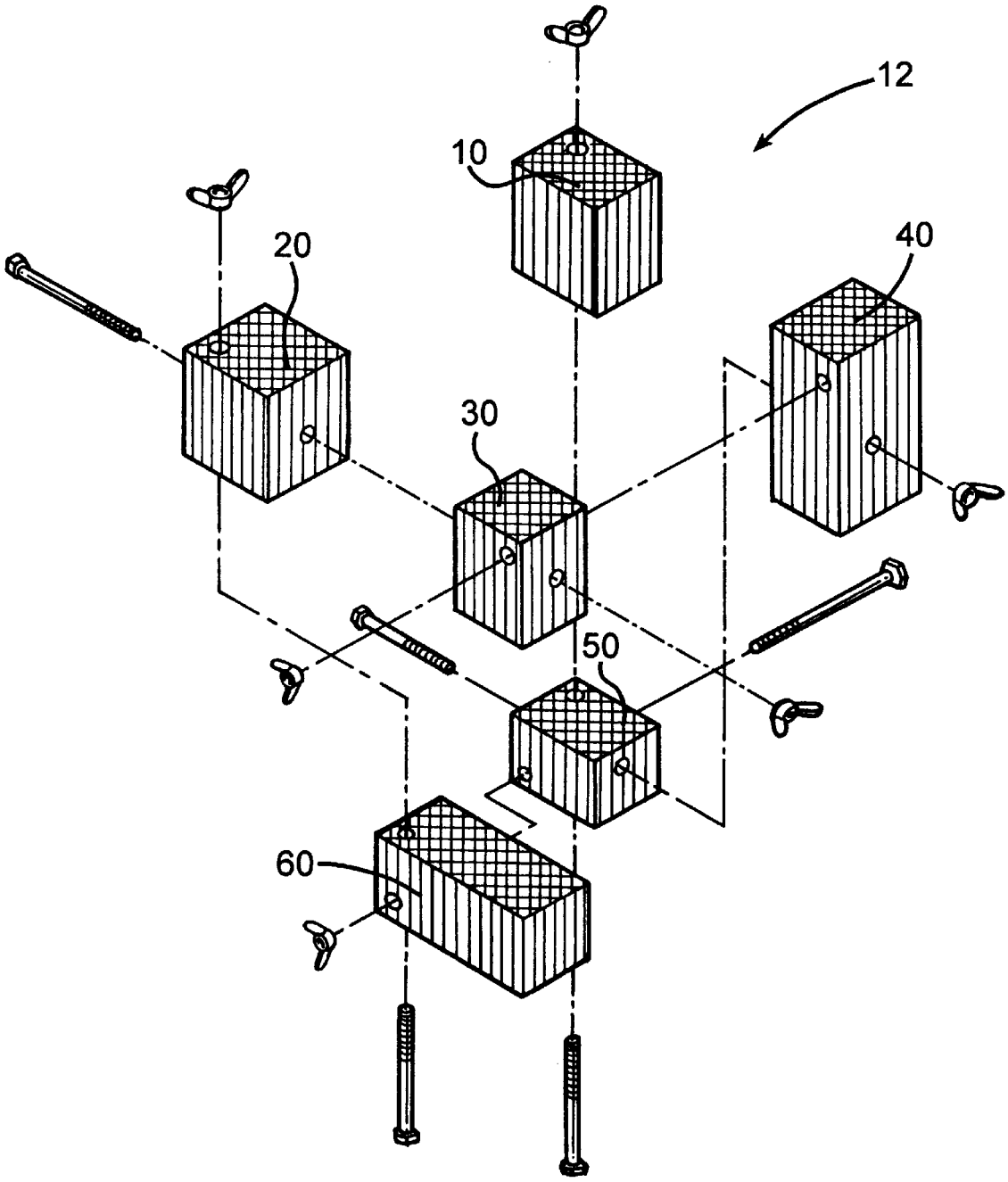
FIG. 5 is an exploded perspective view of the puzzle showing the bottom, front and left sides of the blocks.
Figure 6:
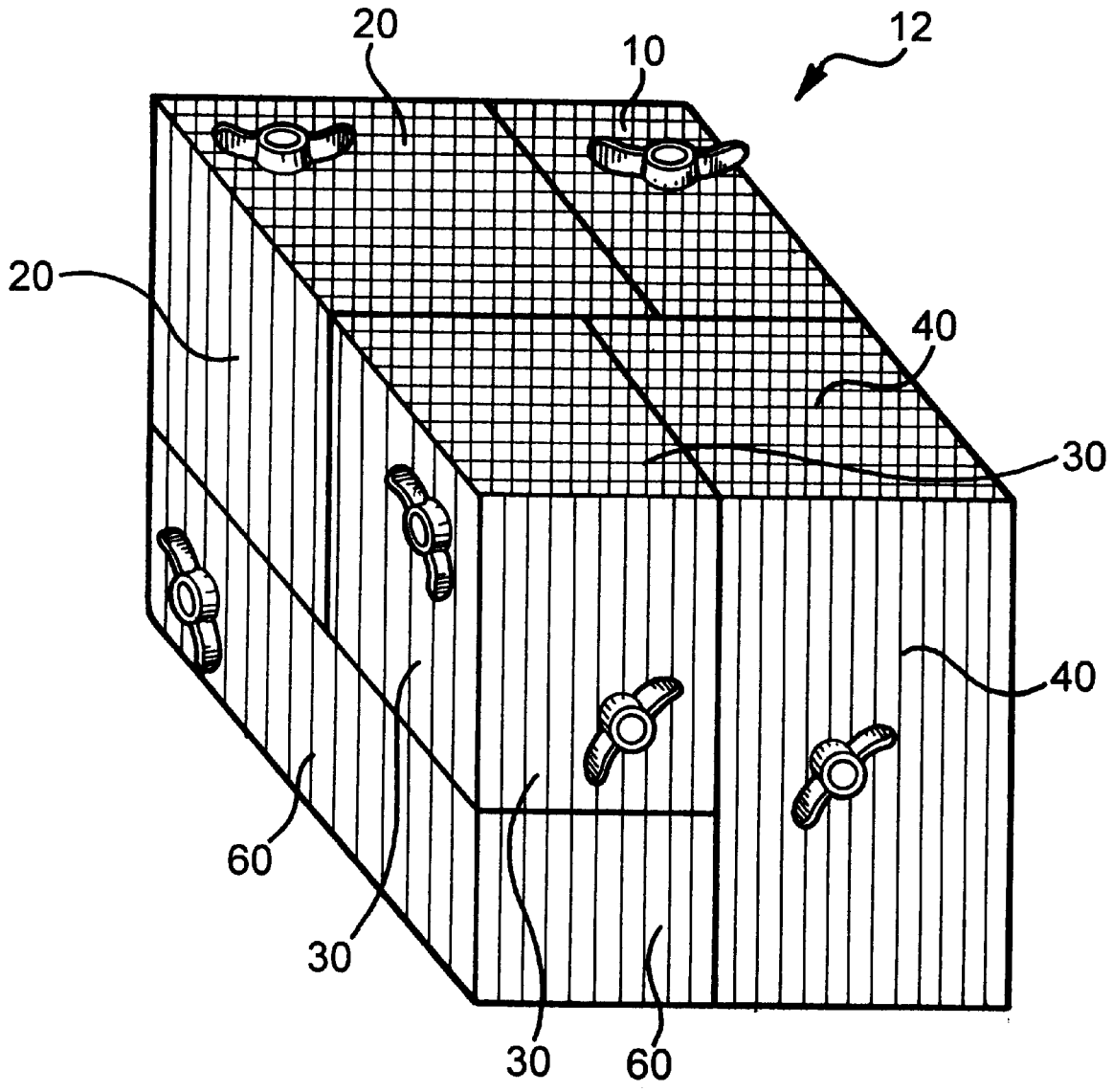
FIG. 6 is a perspective view of the assembled puzzle showing the bottom, front and left sides of the blocks.

With reference now to the drawings, wherein like reference characters designate like or corresponding parts throughout the several views, there is shown one embodiment of puzzle 12 forming a cube when assembled. In accordance with the invention, this embodiment of puzzle 12 includes a plurality of hexahedron blocks 10, 20, 30, 40, 50 and 60. Each block defines at least one hole therein which passes completely through each block, as shown in A the exemplary arrangement in FIGS. 1–6.

A plurality of fastening elements 14, 24, 34, 44, 54 and 64 are provided, which are of substantially identical dimensions with respect to each other. Blocks 10, 20, 30, 40, 50 and 60 can be assembled together in only a single predetermined manner, as shown in FIGS. 1–6, to form a cube 12 with each of fastening elements 14, 24, 34, 44, 54 and 64 passing through predetermined holes of blocks 10, 20, 30, 40, 50 and 60 with the fastening elements not interfering with each other.

Each of blocks 10, 20, 30, 40, 50 and 60 typically defines a plurality of holes therein, but different embodiments of puzzle 12 may be provided wherein some of blocks 10–60 define only a single hole therein.

The configurations of blocks 10–60 and the locations of holes within blocks 10–60 are such as to permit blocks 10–60 to be assembled together with fastening elements 14–64 in only a single configuration with respect to each other to form cube 12.

All planar surfaces of each block 10–60 are preferably substantially perpendicular to each abutting planar surface of the block.

Further in accordance with the invention, fastening elements 14–64 respectively include threaded bolts 16, 26, 36, 46, 56 and 66 and wing-nuts 18, 28, 38, 48, 58 and 68, respectively, for threadably connecting to the bolts. Bolts 16–66 and the holes within blocks 10–60 are sized to permit bolts 16–66 to pass freely through the holes. To permit the protrusion of all bolts 16–66 so that nuts 18–68 can be fastened to the bolts, the length, width and height dimensions of each cube puzzle 12 are preferably approximately one-quarter inch less than the length of each of bolts 16–66. This will enable the threaded end of each of the bolts to protrude from cube 12 and will enable nuts 18–68 to be threaded onto the bolts.

Each of blocks 10–60 may define a different set of length, width and height dimensions from each of the other blocks, but some embodiments of the invention may provide for certain of blocks 10–60 to have the same dimensions. No two blocks 10–60, however, are identical to each other with respect to hole location within the blocks. Each of blocks 10–60 may be made from solid wood, plastic or other suitable material.

In order to influence the difficulty of solving each puzzle cube 12, at least some of the planar surfaces or faces of blocks 10–60 are preferably decorated in a predetermined manner. The decoration of some or all of the surfaces of blocks 10–60 can increase or decrease the difficulty of solving puzzle cube 12.

One example of such a decoration package is shown in FIGS. 1–6 wherein all surfaces of each of blocks 10–60 are colored. In this embodiment, each of the six faces of cube 12 is a different color and each of the six faces of each of blocks 10–60 within cube 12 is similarly colored. For example, in the embodiment shown in FIGS. 1–6, the top face of puzzle cube 12 and the top surface of each of blocks 10–60 is green, the front face of cube 12 and the front surface of each block 10–60 is yellow, the left side face of cube 12 and the left surface of each block 10–60 is red, the right face of cube 12 and the right surface of each block 10–60 is orange, the bottom face of cube 12 and the bottom surface of each block 10–60 is pink and the back face of cube 12 and the back surface of each of blocks 10–60 is blue.

Additional embodiments of the invention, not shown, can include a greater or lesser number of blocks to form a puzzle cube and can use a greater or lesser number of fastening elements to increase or decrease the complexity of the puzzle.

Each embodiment of the invention requires positioning of the blocks with holes within the blocks aligned with holes within adjacent blocks in a unique pattern. No other pattern will allow putting the bolt block puzzle apparatus together utilizing all the blocks, bolts and nuts.

In addition to the decoration pattern described and illustrated herein, additional or other designs and/or decorations may be painted or otherwise colored onto the blocks, such as lines, arrows, dots, figures, patterns,pictures or the like which facilitate aligning the blocks into the unique pattern which results in formation of a cube.

Another decoration package embodiment of the invention, not shown, provides for all faces of each of the blocks to be of a first color with multiple, e.g. three, intersecting bands of a different color surrounding the cube and surrounding each block in the paths of the bands.

Another decoration package embodiment, not shown, applies three colors twice each to opposite sides of the cube and to each block, and the same three colors form three intersecting bands around the cube and around each block. For example, the front and back faces of the cube and those of each block are blue; the left and right faces of the cube and of each block are green; the top and bottom faces of the cube and of each block are pink. These same three colors are also applied to three intersecting bands which surround the cube and which also surround each block they encounter. The blue band surrounds the green and pink faces, the green band surrounds the blue and pink faces, and the pink band surrounds the blue and green sides.

Another decoration package embodiment, not shown, provides that four colors are displayed on opposite corners of the cube. This results in the formation of a square on each face of the cube. The front and right squares are pink, the top and left squares are light blue, and the back and bottom squares are dark blue, for example. Corner colors, for example, are red, green, yellow and orange. The colors in this decoration package are applied only to the exterior faces of all blocks. All other faces of each of the blocks are preferably wood grain stained.

Another decoration package embodiment, not shown, provides that four faces of the cube and four faces of each block contained within the cube are yellow, for example. The remaining two opposite end faces of the cube and of each block are red, for example. Three parallel spaced red bands, for example, wind around the four contiguous yellow sides of the cube and, also, around every block with which each band comes into contact.

Another decoration embodiment, not shown, provides for each face of the puzzle cube and of each block to be of a different color and provides for three intersecting bands of three different colors which surround the exterior of the puzzle and which are positioned around each of the blocks. The diameters of the bolts used in this puzzle or in any of the other puzzle embodiments can be larger, such as a 5/16 inch diameter rather than a 4/16 inch diameter, so that persons in rehabilitation can get a better grip on both the bolt and the wing-nut associated with each bolt.

The invention in its broader aspects is not limited to the specific details shown and described, and departures may be made from such details without departing from the principles of the invention and without sacrificing its chief advantages.

What is claimed is:

1. A puzzle capable of forming only a cube when assembled, said puzzle comprising:

a plurality of hexahedron blocks, each block defining at least one hole therein which passes completely through said block;

only a plurality of fastening elements of substantially identical dimensions with respect to each other; and wherein all of said blocks and all of said fastening elements can be assembled together in only a single predetermined manner with respect to each other to form only a cube with each of said plurality of fastening elements passing through predetermined holes of said blocks.

2. A puzzle as in claim 1 wherein at least one of said plurality of blocks defines a plurality of holes therein.

3. A puzzle as in claim 1 wherein each planar surface of each of said hexahedron blocks is substantially perpendicular to each additional planar surface which abuts said planar surface.

4. A puzzle as in claim 1 wherein each of said plurality of fastening elements includes a threaded bolt and a nut for threadably connecting to said bolt.

5. A puzzle as in claim 4 wherein said bolts and said holes are sized to permit said bolts to pass through said holes.

6. A puzzle as in claim 1 wherein each of said plurality of blocks defines a different set of dimensions from each of the other blocks in said plurality of blocks.

7. A puzzle as in claim 1 wherein at least one of said plurality of blocks defines a different set of dimensions from the other blocks in said plurality of blocks.

8. A puzzle as in claim 1 wherein no two blocks are identical to each other with respect to hole location within said blocks.

9. A puzzle as in claim 1 wherein at least some of the planar surfaces of said hexahedron blocks are decorated.

10. A puzzle as in claim 1 wherein each of said blocks is a solid of wood.

11. A puzzle as in claim 1 wherein each of said blocks is a solid of plastic.

* * * * *